United States Patent [19]

Mallant

[11] Patent Number: 4,799,596

[45] Date of Patent: Jan. 24, 1989

[54] PROCESS AND APPARATUS FOR CONTROLLING A SORTING MACHINE

[75] Inventor: Jos P. Mallant, Hamburg, Fed. Rep. of Germany

[73] Assignee: Justus Technik GmbH Industrie-Anlagen, Hamburg, Fed. Rep. of Germany

[21] Appl. No.: 24,081

[22] Filed: Mar. 10, 1987

[30] Foreign Application Priority Data

Apr. 25, 1986 [DE] Fed. Rep. of Germany ..... 3614400

[51] Int. Cl.[4] ..... B07C 5/342

[52] U.S. Cl. ..... 209/580; 209/587

[58] Field of Search ..... 209/580, 581, 585, 587, 209/588

[56] References Cited

U.S. PATENT DOCUMENTS

| | | | |
|---|---|---|---|
| 4,120,402 | 10/1978 | Swanson | 209/587 |
| 4,147,619 | 4/1979 | Wassmer et al. | 209/587 |
| 4,166,541 | 9/1979 | Smith | 209/587 |
| 4,369,886 | 1/1983 | Lane et al. | 209/587 |
| 4,454,029 | 6/1984 | Codding | 209/587 |
| 4,634,881 | 1/1987 | Billion | 209/587 |

FOREIGN PATENT DOCUMENTS

| | | |
|---|---|---|
| 3103371 | 8/1982 | Fed. Rep. of Germany . |
| 3434332 | 3/1985 | Fed. Rep. of Germany . |

*Primary Examiner*—Sherman D. Basinger
*Assistant Examiner*—Stephen P. Avila
*Attorney, Agent, or Firm*—Cushman, Darby & Cushman

[57] ABSTRACT

Method and apparatus for controlling a color sorting machine which sorts particulate products based on a color difference between the product and a background. A photoelectric cell receives light reflected from the product and provides an output signal to a microprocessor. The microprocessor uses photoelectric cell output signals of known good products to establish a range of predetermined acceptance values. If the detected signal falls outside the predetermined range, it is determined that the product is defective and an eject signal is provided to an ejector which ejects the bad product from the machine. Outside of the microprocessor, a comparator first compares the photoelectric output signals with the predetermined range of values established by the microprocessor. If the comparator detects a defective product, it provides an eject signal to the microprocessor which then commands the ejector to eject the defective product.

18 Claims, 4 Drawing Sheets

PROCESS AND APPARATUS FOR CONTROLLING A SORTING MACHINE

BACKGROUND OF THE INVENTION

The present invention relates to a process for controlling a color sorting machine which preferably processes agricultural products with the aid of a microprocessor. Light reflected from the product is directed to a photoelectric cell. Photoelectric cell output signals are fed into the microprocessor and compared with given values for known good products. When a variation between a photoelectric cell output signal and a given set value exists, an ejector is actuated, which discharges the relevant product. The invention also relates to an apparatus for performing the process.

U.S. Pat. No. 4,454,029 discloses a process of controlling a color sorting machine for agricultural products, e.g. coffee beans, peanuts, peas, etc. in such a way that each product is associated with a given background color corresponding to the product. The product to be sorted is then led past the background and illuminated from at least one light source. If the product color roughly corresponds with the given background, then a signal processing circuit provides no instruction to the ejector. Thus, the product remains on its conveying path. However, if the signal processing circuit establishes a color variation between the product and the background, a discharge instruction is produced for the ejector and is applied to the latter after appropriate signal conditioning and time lag. With a correct time lag matched to the conveying speed of the product, the ejector is then operated which, with a short, powerful air jet, then ejects the background-differing product from the run of conveyed products. The necessary control circuitry is constructed in conventional analog technology and TTL-logic and therefore corresponds to the prior art of the early seventies.

SUMMARY OF THE INVENTION

An object of the present invention is to provide a process for controlling a color sorting machine and an apparatus for performing the process with a microprocessor. The apparatus and method allow a very compact and economically advantageous color sorting machine to be realized.

According to the present invention, this object is achieved by a process of the aforementioned type, which is characterized in that for reducing the operating steps of the microprocessor, outside the latter there is performed a comparison of the individual photoelectric cell signals with the limit values produced by the microprocessor and that information is only supplied to the microprocessor if a photoelectric cell discovers a product differing from the given values.

Thus, by means of a smaller microprocessor it is possible to process the same number of photoelectric cell signal channels as with a larger microprocessor. Thus, for example, in place of a complicated 32 bit microprocessor, it is possible to use a simpler 8 or 16 bit microprocessor, whose associated development system is significantly less expensive. In addition, the programming of a smaller microprocessor is simpler and at present also better known. In other words, it is easier to find programmers able to program a smaller 8 or 16 bit microprocessor for use in color sorting machine than for a 32 bit microprocessor.

Apart from the different component control and monitoring functions, the programming of the microprocessor also comprises the setting up and giving of the product signal limit values, which are e.g. obtained by a process in which, for a certain period of time, only completely satisfactory products are dealt with. For each of these product signals, the microprocessor determines an upper, middle and lower limit value, the middle or mean limit value being used as the zero value or as a small range about an assumed zero line. As a function of the microprocessor programming, the upper and lower limit values differ from the assumed zero line, typical signal ranges being ±1-3 V. However, it is obvious that the microprocessor can be given other limit values. Thus, in this way there is no need to physically select and color the product background, and the adaptation of background and product can take place electronically in the microprocessor. This is obviously a significant advantage for the user. The microprocessor is also able to continuously adapt to the photoelectric cell signals in such a way that with a gradual background change due to dust or dirt, aging of lamps, drift of the photoelectric cell operating point, etc., there is an adaptation of the existing operating state.

BRIEF DESCRIPTION OF THE DRAWINGS

Advantageous features of the invention can be gathered from the appended claims and the following description relative to the drawings. The invention is described hereinafter relative to an embodiment and the attached drawings, in which:

DETAILED DESCRIPTION OF THE PRESENTLY PREFERRED EXEMPLARY EMBODIMENT

Figure 1:
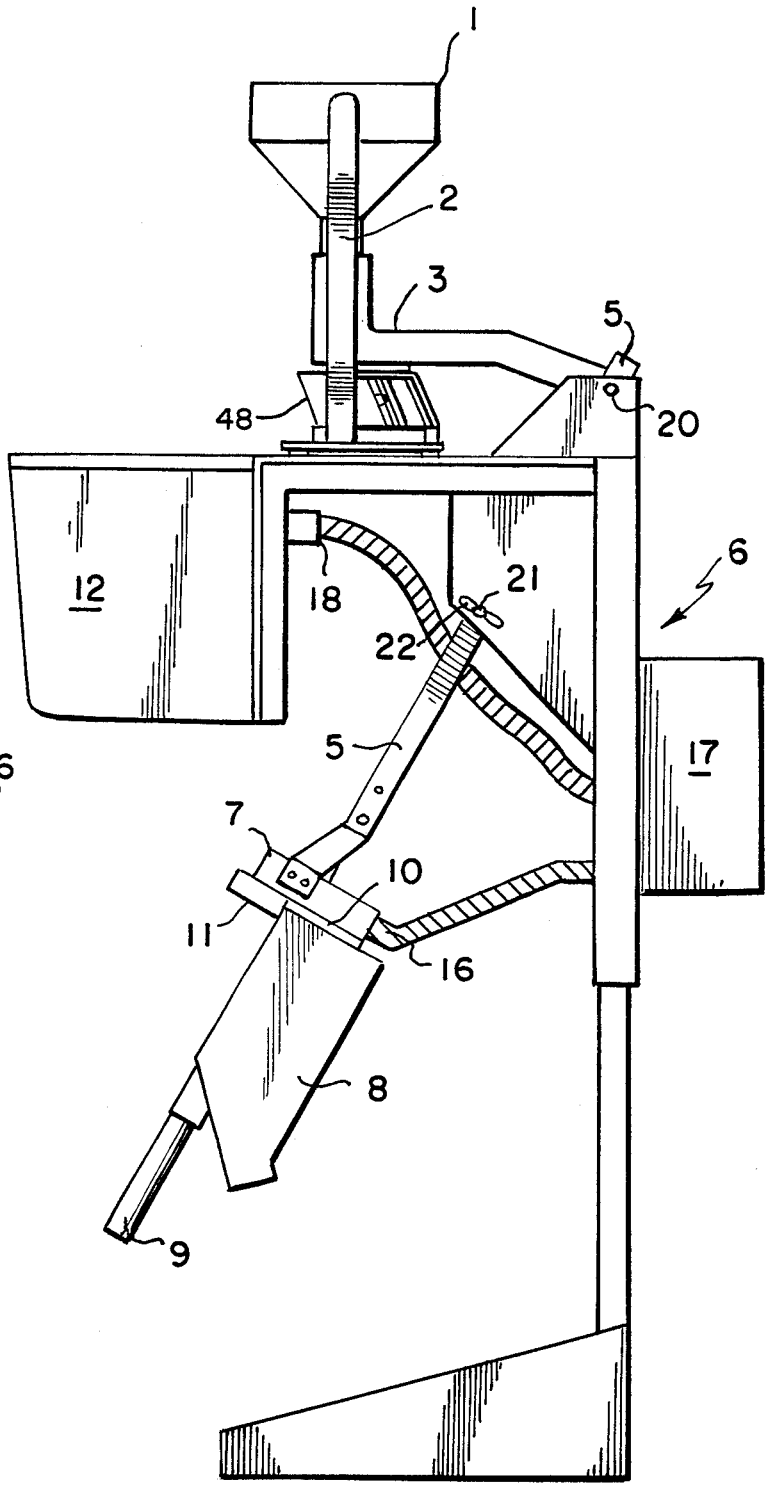
FIG. 1 is a diagrammatic side view of a sorting machine.

FIG. 1 shows a color sorting machine for agricultural products such as peas, rice, seed, hazelnuts, beans, etc., i.e. for small articles which, after separation, are to be sorted in such a way that good products are separated from bad. Therefore, on a C-shaped frame 6 is mounted a hopper 1, which serves to receive the product to be sorted. For reasons to be described hereinafter, hopper 1 can be oriented or aligned by means of posts 2 at the top of frame 6. From hopper 1 a chute 3 passes into a slide 5, which is suspended from a pivot point 20 and is supported in a support 21. The latter is constituted by a pin, which is guided in a slot 22 and therefore permits a slope change of the slide 5 to adapt to the product to be sorted. Conventionally, slide 5 is an approximately V-shaped channel, which is open at the top, has rounded ends, or in another embodiment is a closed tube. The choice of the cross-sectional shape for slide 5 is essentially dependent on the nature of the product to be sorted and is made such that the individual products, individually separated in succession like pearls on a string, slide downwards to an observation head 7. A vibrating conveyor 48 acts on chute 3 and brings about a prealignment and simultaneous conveying of the product from hopper 1 to slide 5.

Beneath the observation head 7 is provided an ejecting slide 8, which branches off from a product slide 9 used for the satisfactory product. Between observation head 7 and ejection slide 8 is provided an ejector 11 which, as a result of a corresponding signal from observation head 7, discharges faulty products from the product flow through a short, highly directional air jet and diverts same into the ejection slide 8. A slide mount 10 is adjustably mounted beneath the observation head 7, so that it is possible to adjust the position of ejection slide 8 and product slide 9 with respect to ejector 11 and observation head 7. An electronic control for the operation of the sorting machine is housed in a box 12, which is fitted to the upper, horizontal leg of frame 6. A fan 17 is also mounted on the back of frame 6, which is connected by means of an air line 16 to the observation head 7. Fan 17 is also connected by means of a line 18 to the box 12 for the control electronics, in order to supply cooling air thereto.

Figure 2:
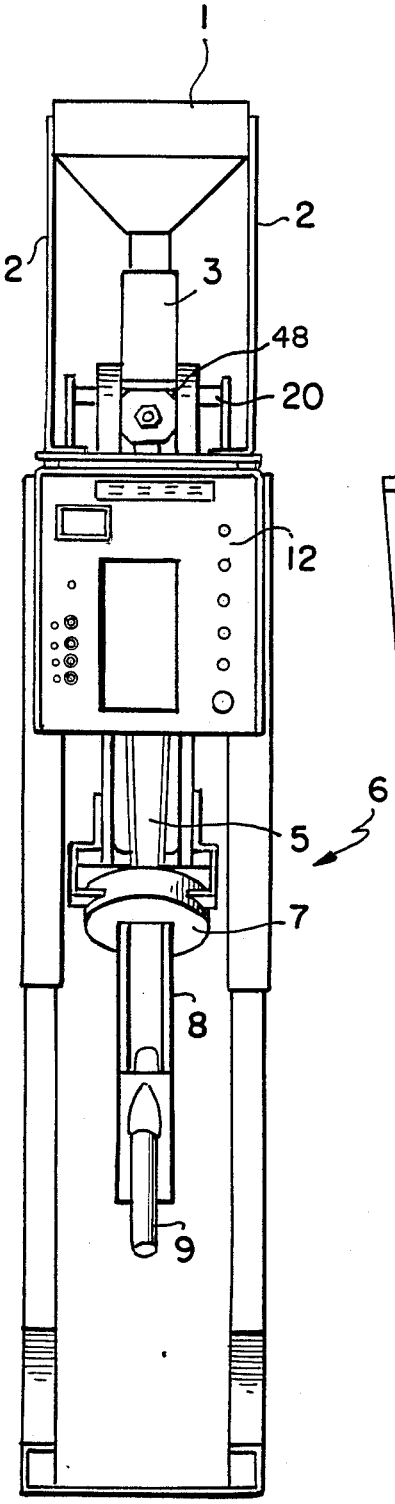
FIG. 2 is a front view of the sorting machine of FIG. 1.

FIG. 2 is a diagrammatic front view of the color sorting machine, all parts not being provided with reference numerals, but the same parts are given the same reference numerals.

Figure 3:
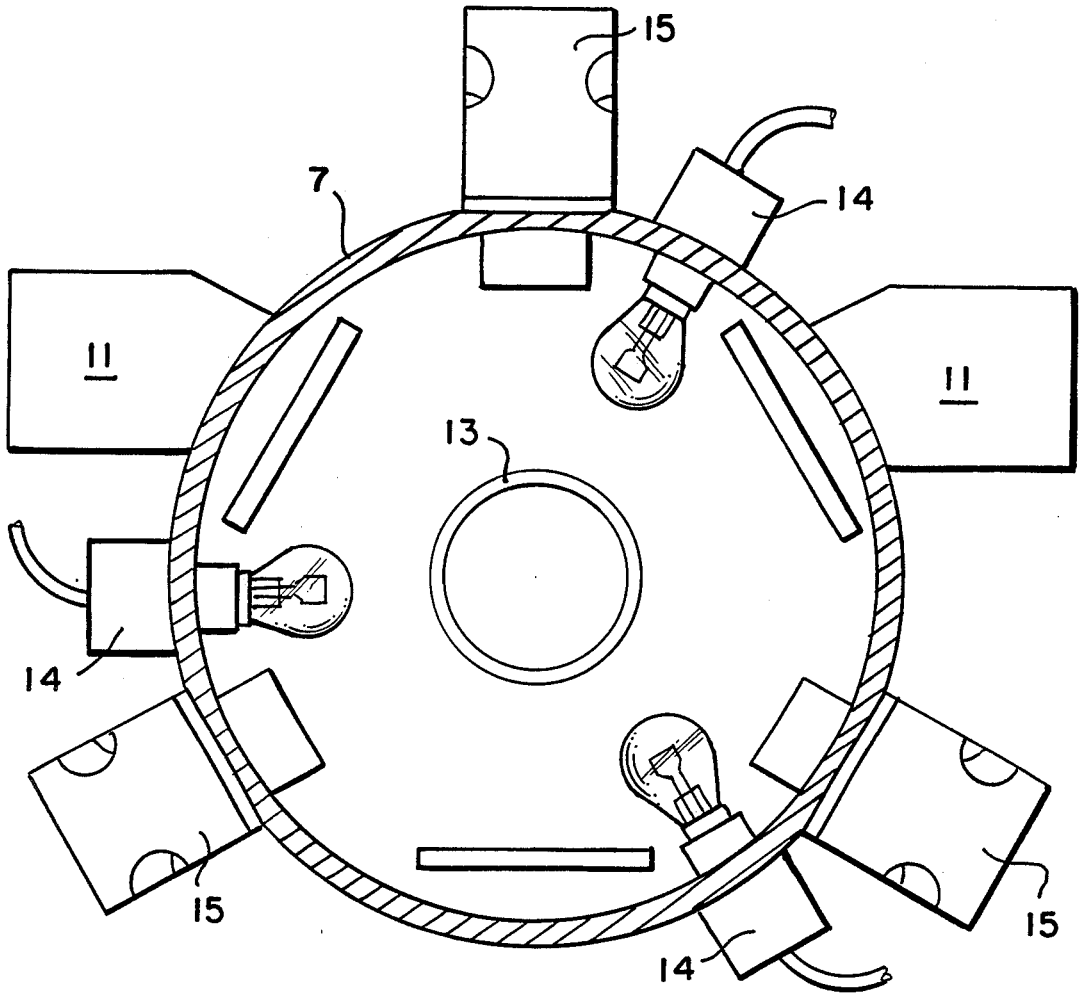
FIG. 3 is a part sectional plan view of an observation head of the apparatus according to FIGS. 1 or 2.

FIG. 3 is a partial section through observation head 7, in which three lamps 14 are arranged with spacing of 120° about a circular central portion 13. Beside each lamp 14 is also provided a photoelectric cell arrangement 15, which contains part of the signal processing logic. Thus, the three photoelectric cell arrangements are also arranged at 120° intervals. The ejector 11 is installed below the observation head 7, being only diagrammatically indicated in the view of FIG. 3. Blowing heads (not shown) are provided in the tubular central portion 13 of observation head 7 for blowing deposited dust and similar impurities out of the light paths between lamps 14 and photoelectric cell arrangements 15.

The observation head 7 shown in FIG. 3 is known per se and does not form part of the invention. It is clear to the person of ordinary skill in this field how such an observation head is to be constructed and operated.

Figure 4:
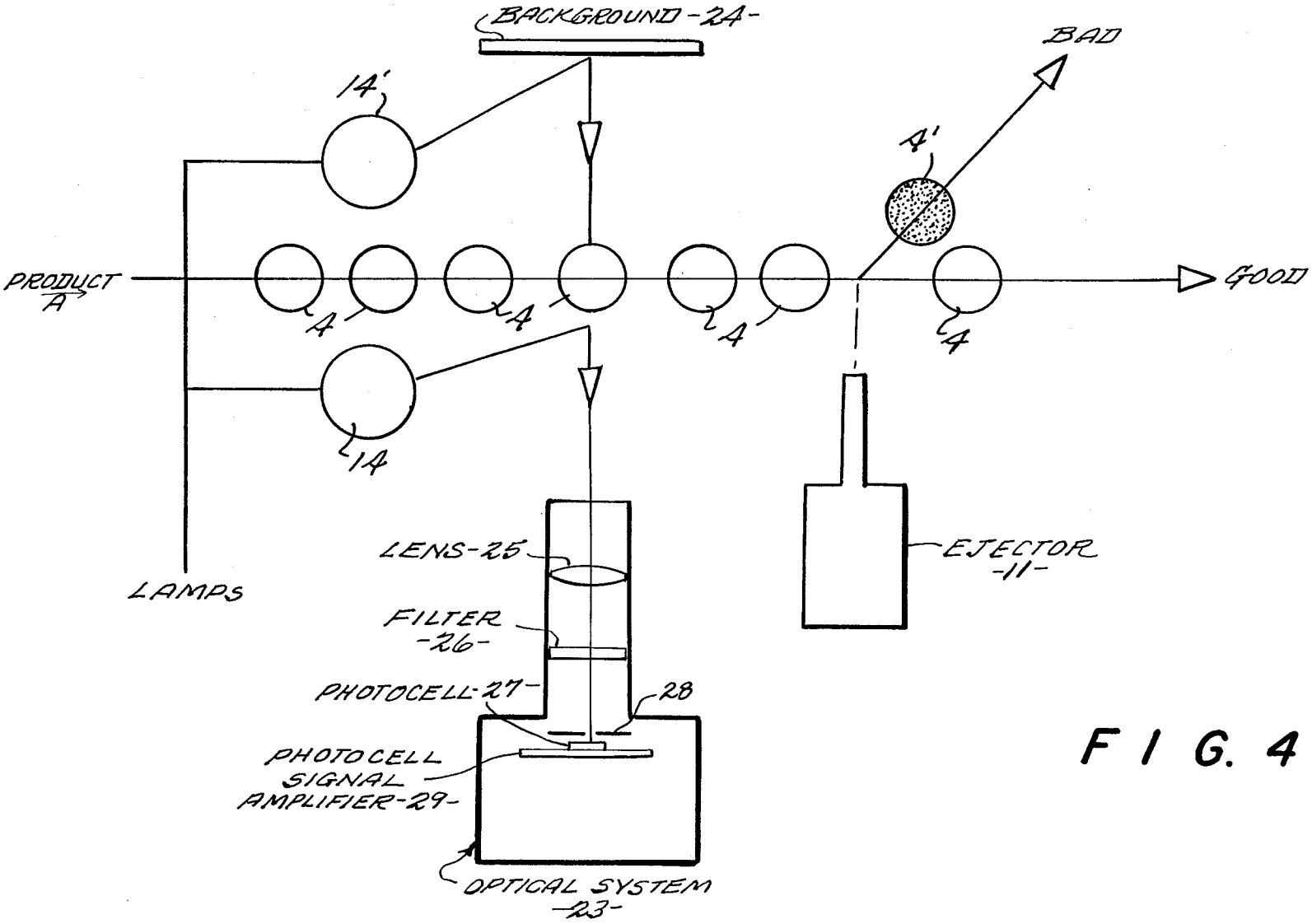
FIG. 4 is a diagrammatic representation of the observation and sorting out process.

FIG. 4 diagrammatically shows the operation of observation head 7, in which product 4 to be sorted is moved past an optical means 23. The product 4 passes between two lamps 14 and 14', whereof one lamp 14 illuminates the front of product 4 and the other lamp 14' illustrates a background 24 which has been adapted to the color of product 4. The light from both the first and the second lamps 14 and 14' is received by optical system 23 and is passed by a lens 25 and a filter 26 to a photoelectric cell 27, upstream of which is provided a diaphragm 28. Photoelectric cell 27 is followed by an amplifier 29, which preamplifies the photoelectric cell signal to a value suitable for further signal processing. In the conveying direction A of product 4, downstream of optical system 23 is arranged ejector 11, which separates good product 4 from unsatisfactory product 4' when actuated by the photoelectric cell signal amplifier 29. This takes place in such a way that in the case of a corresponding signal from amplifier 29, the ejector 11 is activated and discharges the unsatisfactory product 4' from the feed flow by means of a highly directional, brief, compressed jet of air.

Background 24 is roughly adapted to the good product 4, so that when there is no product, light from background 24 strikes photoelectric cell 27. This light essentially comes from the rear lamp 14', because the light from the front lamp 14 is not reflected into optical system 23 due to the lack of a product 4. However, if a product 4 is passed between lamps 14 and 14' and to optical system 23, then product 4 on the optical axis of photoelectric cell 27 and lens 25 attenuates the light from the front lamp 14' and thus compensates the attenuation of the light striking photoelectric cell 27. However, an inferior product 4' would not completely compensate the blocked off light from the rear lamp 14' and instead, as a function of whether it is a light or dark product 4', would reflect either too much or too little light from front lamp 14, so that, following a corresponding setting of the signal processing circuit, actuator 11 would be operated.

Figure 5:
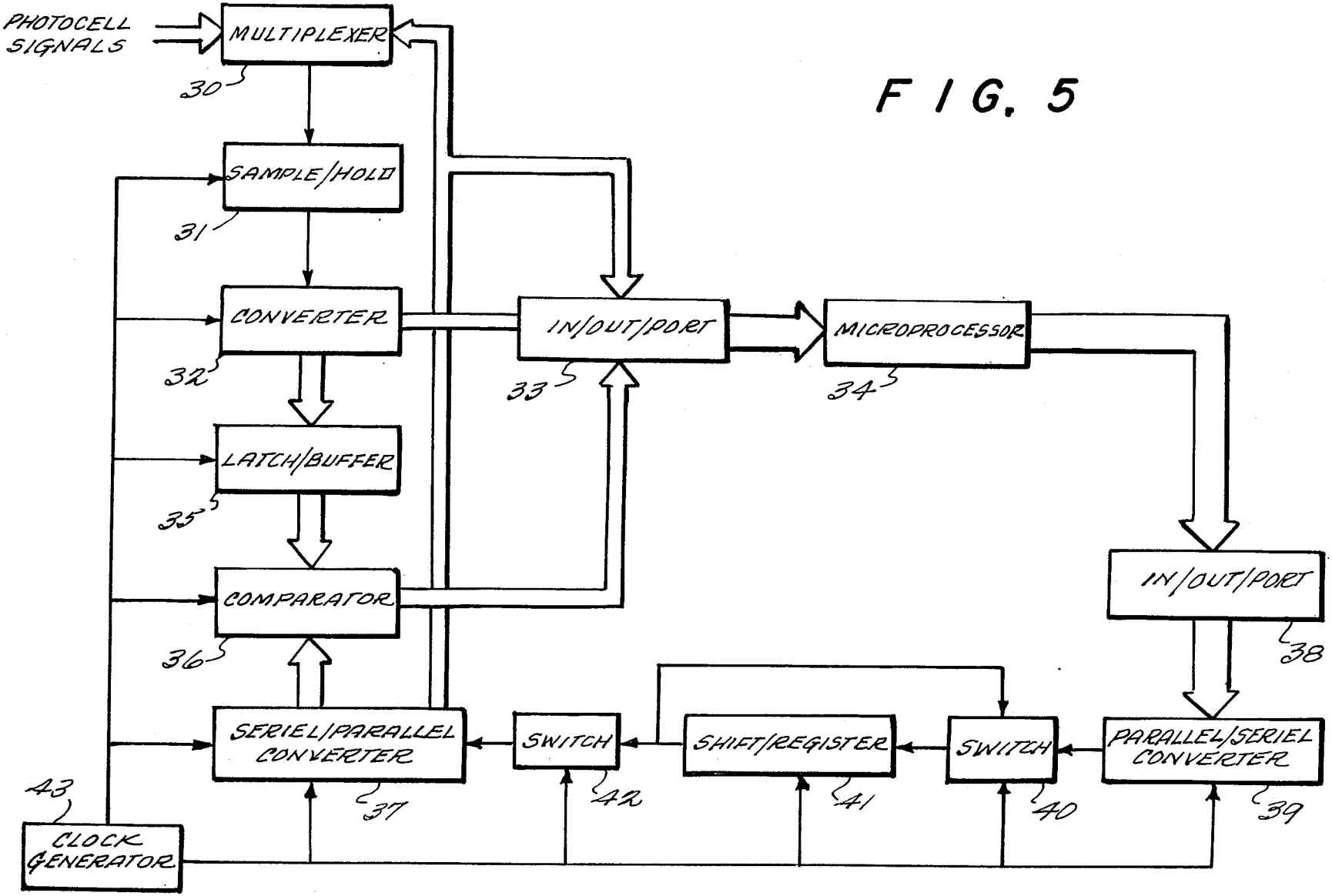
FIG. 5 is a block circuit diagram of the sorting control.

FIG. 5 shows the sorting control circuit, which processes the photoelectric cell signals of photoelectric cell 27 according to FIG. 4 and applies same to ejector 11. As a sorting machine can have more than one slide 5 and there can be more than one optical system 23 per slide 5, photoelectric cell signals are successively applied to a multiplexer 30. The latter is followed by a sample and hold circuit 31, which intermediately stores the photoelectric cell signals of the individual photoelectric cell channels until a following analog-digital converter 32 has converted the analog signals to digital signals. Analog-digital converter 32 is on the one hand connected to an input circuit 33 for a microprocessor 34, and on the other hand to a latch/buffer store 35. The outputs of buffer store 35 are applied to first inputs of a comparator 36, whose second inputs are connected to the outputs of as serial-parallel converter 37. The output terminals of the comparator are also connected to the input circuit 33 of microprocessor 34. In addition, part of the output lines of the serial-parallel converter 37 are applied to multiplexer 30 and also to input circuit 33.

In a per se known manner, at the output of microprocessor 34 is provided an input/output circuit 38, which is on the one hand connected in a not shown manner to ejector 11, and on the other hand controls a parallel-serial converter 39. The latter is connected via a first switch 40 to a shift register 41, which is in turn connected via a second switch 42 to the input of the serial-parallel converter 37. Finally, clock generator 43 controls all the aforementioned components of the storing control circuit.

In an appropriate construction of the invention, the individual components of the sorting control circuit are realized by the following electronic components. Multiplexer 30 by an AD/506; sample and hold circuit 31 by an AD 585; the analog-digital converter 32 by an ADC 84/85; buffer store 35 by a 1½ 74LS373; comparator 36 by 3 X 74LS85; the serial-parallel converter 37 by a 74LS373; the second switch 42 by a 74LS00; the shift register 41 by a 3 X HEF 4731; the first switch 40 by a 74LS00 and the parallel-serial converter 39 by a 74SL674. TTL logic can be used for the clock generator 43. A Z80A CPU was used as microprocessor 34 with input/output circuits 33, 38 of type Z80 A PIO. Therefore, the microprocessor of this embodiment is an 8 bit microprocessor.

The operation of the sorting control circuit according to FIG. 5 will now be described. Specifically, firstly the electronic setting of the background and then the processing or evaluation will be described. Processing initially takes place only with satisfactory products and the individual photoelectric cell signals are applied by multiplexer 30 to the sample and hold circuit 31. The individual signals are supplied by circuit 31 in the form of analog signals to the analog-digital converter 32 and converted into digital signals. The digitized photoelectric cell signals are passed into the buffer store 35 and also via the input/output circuit 33 are supplied to microprocessor 34. Microprocessor 34 is programmed in such away that in the case of satisfactory products it defines a zero line or zero line range and associates therewith an upper limit of e.g. 10 V and a lower limit of e.g. 0 V. If the photoelectric cell signals for satisfactory products are e.g. at +5 V, then the microprocessor 34 defines +7 V as the upper limit and +3 V as the lower limit. A third limit value of about 9.5 V indicates the presence of a product and enables the μP (microprocessor) to make a comparison. These three limit values are supplied by means of the input/output circuit 38 e.g. in 16 bit form, as a function of the number of photoelectric cells or channels used. The parallel-outputted limit value data are converted into serial data and introduced into the shift register 41 by the first switch 40 initially timed at 100 kHz by clock generator 43. At this time, the second switch 42 blocks the transfer of the shift register data to the serial-parallel converter 37. The shift register 41 is now successively loaded with the 16 bit representation of the upper, middle and lower limit value of the individual photoelectric cell signals until shift register 41 is full or the limit value has been fed in for all channels. Clock generator 43 then switches from 100 kHz to 4 MHz and controls the first switch 40 in such a way that the shift register 41 operates as a ring counter. This means that the individual limit data are fed out at one end of the shift register and fed in again at the other end. When using 16 photoelectric cells, and in each case three limit values per photoelectric cell in the 16 bit representation, the shift register 41 must be 768 bits long. If clock generator 43 is now switched over to 4 MHz, the individual limit value data from shift register 41 are also allowed to pass through via second switch 42 to the serial-parallel converter 37 and are applied by the later as parallel data to comparator 36. However, of each limit value word only part of the bits, e.g. 12 bits are required for defining the limit, whereas another part, e.g. 4 bits is used for identifying the particular channel. In the case of a 16 bit representation, for example, 4 bits are used for informing multiplexer 30 as to which channel is controlled or selected, so that a comparison takes place in comparator 36 of the limit value data belonging to said channel or said photoelectric cell. In comparator 36 (located outside and upstream of microprocessor 34), a comparison takes place as to whether the particular photoelectric cell signal processed is inside or outside the given limit values. Only if it is outside the given limit values does the comparator 36 supply a signal to microprocessor 34 and namely via its input circuit 33, so that microprocessor 34 only has to initiate a control process in this case and actuate ejector 11. Thus, the operating speed of a relatively small 8 or 16 bit microprocessor is sufficient for controlling a sorting machine with several photoelectric cell channels. Without the comparator according to the invention, it would be necessary to use a larger microprocessor for achieving the same signal processing speed and capacity. However, a larger microprocessor is much more expensive and more difficult to program. Its peripheral components are also much more complicated and in particular it would have to have its own complicated development system for programming the microprocessor. However, a smaller 8 or 16 bit microprocessor can be programmed with a conventional home computer.

While the invention has been described in connection with what is pesently considered to be the most practical and preferred embodiment, it is to be understood that the invention is not limited to the disclosed embodiment but, on the contrary, is intended to cover various modifications and equivalent arrangements included within the spirit and scope of the appended claims.

I claim:

1. Apparatus for sorting a product based on reflected light, comprising:

photoelectric means for receiving light reflected from said product and providing an output signal having value corresponding to a light level of said reflected light, wherein said photoelectric means includes a plurality of channels for parallel processing said product, each channel including a phtodetector for receiving light reflected from a corresponding product and for providing an output signal having a value corresponding to a light level of said reflected light;

a comparator for receiving said output signal from said photoelectric means and comparing it with a predetermined range of values, and for providing an eject signal when the value of said output signal is outside said predetermined range of values, wherein said comparator compares each one of the plurality of output signals from the plurality of photodetectors with a corresponding predetermined range of values from a plurality of predetermined range values;

a microprocessor, downstream from said comparator, for receiving said eject signal and providing an eject command corresponding thereto, wherein said microprocessor provides an eject command to eject means which eject the product whose corresponding output signal value is outside the corresponding predetermined range of values;

multiplexer means for receiving said plurality of output signals and providing a multiplexed signal corresponding thereto;

a sample and hold circuit coupled to said multiplexer means;

an analog-to-digital converter coupled to said sample and hold circuit;

a latch buffer coupled to said analog-to-digital converter, and providing an output said comparator; and a serial-to-parallel converter coupled to said multiplexer means and to said comparator.

2. Apparatus according to claim 1 further including shift register means, coupled to said microprocessor and said comparator, for receiving said plurality of predetermined range values from said microprocessor and supplying same to said comparator, said shift register means acting as a ring counter to cyclically shift said plurality of predetermined values within said shift register means.

3. Apparatus according to claim 2 further including a parallel-to-serial converter coupled between said microprocessor and said shift register means.

4. Apparatus according to claim 3 further including a clock coupled to said parallel-to-serial converter, said shift register means, and said comparator.

5. Apparatus according to claim 3 further including microprocessor output circuitry coupled between said microprocessor and said parallel-to-serial converter, and further including microprocessor input circuitry coupled between said comparator and said microprocessor.

6. Apparatus according to claim 2 further including first and second switches coupled respectively to an input and an output of said shift register means.

7. Apparatus for sorting a plurality of products based on reflected light, comprising:

a plurality of processing channels for parallel sorting said plurality of products;

a plurality of photodetectors, each photodetector connected to a respective processing channel and providing an output signal having a value corresponding to a light level of light reflected from one of said products in the corresponding processing channel;

multiplexing means for receiving the output signals from said plurality of photodetectors, and providing a multiplexed signal;

analog-to-digital converter means for receiving said multiplexed signal and providing a digital output signal corresponding thereto;

comparator means for receiving said digital output signal and successively comparing the values of said output signals with corresponding ones of a plurality of predetermined range values, and for providing an eject signal when any one of said output signal values exceeds its corresponding predetermined range values;

a microprocessor for receiving said eject signal from said comparator means, and for providing an eject command corresponding thereto, and for providing said plurality of predetermined range values to said comparator means; and ejecting means, coupled to said plurality of processing channels, for ejecting defective product in response to said eject command.

8. Apparatus according to claim 7 further including a shift register coupled between said microprocessor and said comparator means, for receiving said plurality of predetermined range values from said microprocessor and supplying same to said comparator means, said shift register operating as a ring counter to cyclically shift said plurality of predetermined range values within said shift register.

9. Apparatus according to claim 8 further including:

a parallel-to-serial converter coupled between said microprocessor and said shift register; and a serial-to-parallel converter coupled between said shift register and said comparator means.

10. Apparatus according to claim 9 further including a clock coupled to said analog-to-digital converter means, said comparator means, said shift register, said parallel-to-digital converter, and said digital-to-parallel converter.

11. Apparatus according to claim 7 further including sample and hold means coupled between said multiplexing means and said analog-to-digital converter means for receiving signals from said multiplexing means and providing an output to said analog-to-digital converter means; and latch buffer means coupled to said analog-to-digital converter means, for providing an output signal to said comparator means.

12. Apparatus according to claim 11 further including a clock coupled to said sample and hold means, said latch buffer means, said analog-to-digital converter means, and to said comparator means.

13. Apparatus according to claim 8 further including first and second switches coupled respectively to an input and an output of said shift register.

14. Apparatus according to claim 13 further including a clock coupled to said first and second switches, said shift register, said analog-to-digital converter, and to said comparator means.

15. Apparatus according to claim 9 further including a clock coupled to said parallel-to-serial converter, said serial-to-parallel converter said shift register, said analog-to-digital converter means and said comparator means.

16. Apparatus according to claim 9 further including microprocessor output circuitry coupled between said microprocessor and said parallel-to-serial converter, and further including microprocessor input circuitry coupled between said comparator means and said microprocessor.

17. Apparatus according to claim 1 wherein said microprocessor includes means for establishing said predetermined range of values by operation of said apparatus with only predefined acceptable products, and wherein said microprocessor provides said predetermined range of values to said comparator.

18. Apparatus according to claim 17 wherein said microprocessor includes means for establishing upper, middle, and lower level range values.

* * * * *